United States Patent [19]

Hawley

[11] 3,935,795

[45] Feb. 3, 1976

[54] ACTUATING MECHANISM

[75] Inventor: Jack S. Hawley, Albany, Calif.

[73] Assignee: Pneumeric Corporation, Castro Valley, Calif.

[22] Filed: Feb. 22, 1972

[21] Appl. No.: 227,943

[52] U.S. Cl. ..... 92/5 R; 91/167 R; 92/39; 92/40; 92/43; 92/44; 92/45

[51] Int. Cl.² ..... F01B 25/26; F01B 31/12

[58] Field of Search ..... 91/167, 36, 37; 92/37, 92/39, 34, 40, 43, 44, 45, 5 R

[56] References Cited

UNITED STATES PATENTS

| | | | |
|---|---|---|---|
| 3,162,365 | 12/1964 | Gizeski | 91/167 |
| 3,242,820 | 3/1966 | Brandstadter | 91/167 |
| 3,548,714 | 12/1970 | Barrett | 91/167 |
| 3,602,096 | 8/1971 | Toth | 91/37 |

OTHER PUBLICATIONS

IBM Technical Disclosure, Polythress, Aug. 9, 1960, (Vol. 3 No. 2 July, 1960).

*Primary Examiner*—Martin P. Schwadron
*Assistant Examiner*—Abraham Hershkovitz
*Attorney, Agent, or Firm*—Kurt A. Tauchen

[57] ABSTRACT

An actuating mechanism for moving an indicator, an operational tool or a structual component with a high degree of precision over precisely predeterminable distances to desired points of operation, which comprise a shaft, slidably mounted upon said shaft in end to end relation a sequence of interconnected actuating components of selectively variable length axially of said shaft each having limit stop means for positively and precisely predetermining its conditions of minimum and maximum length and thus its possible increment in length, said increments being arranged to differ for the individual components, means at one end of the sequence of components on said shaft for positively blocking movement of said sequence of components in one direction while leaving the opposite end free to move on said shaft in response to increases in the axial length of any one of said components, means selectively operable to actuate said components individually so that they assume either their condition of minimum length or their condition of maximum length, and indicator means or means for holding a tool or a structural component carried by the free end of said sequence of components on said shaft.

3 Claims, 7 Drawing Figures

10
12
14
16a
16b
16c
16d
16e
16f
18
18'
20
20'
22a
22b
22c
22d
22e
22f
24
25
26
28
28'
28"
29
29'
29"
36
38
40
46
48
50
56
58
59
60
62
63a
63b
63c
63d
63e
63f
64

10
12
16a
16b
16c
16d
16e
16f
18
18'
20
20'
24
26
28
28'
28"
29
29'
29"
36
38
40
46
50
56
58
59
60
62
63a
63b
63c
63d
63e
63f
64

Fig_3
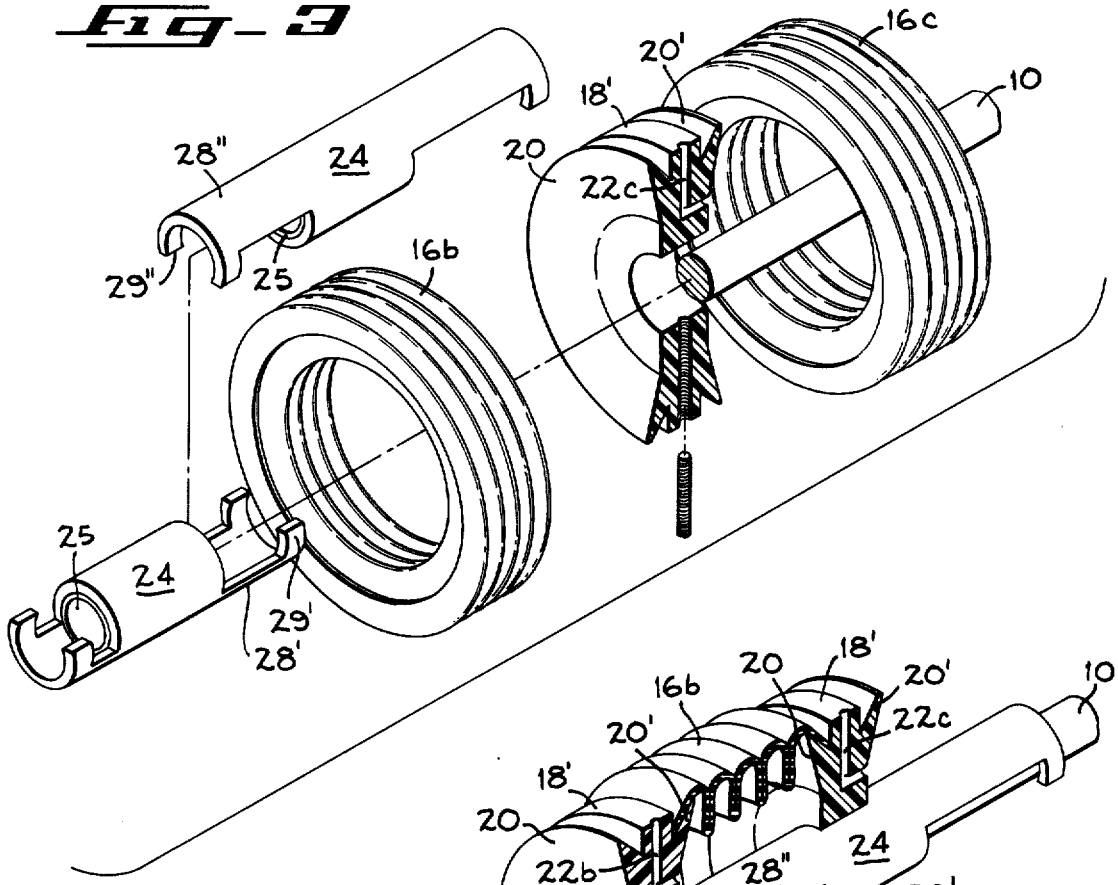
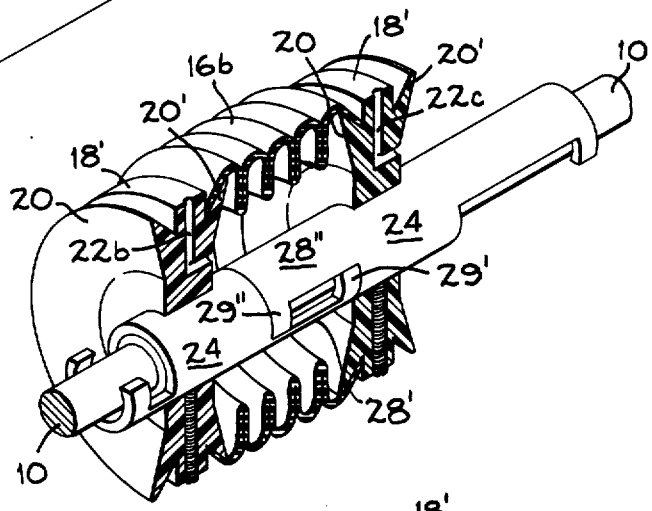
Fig_4
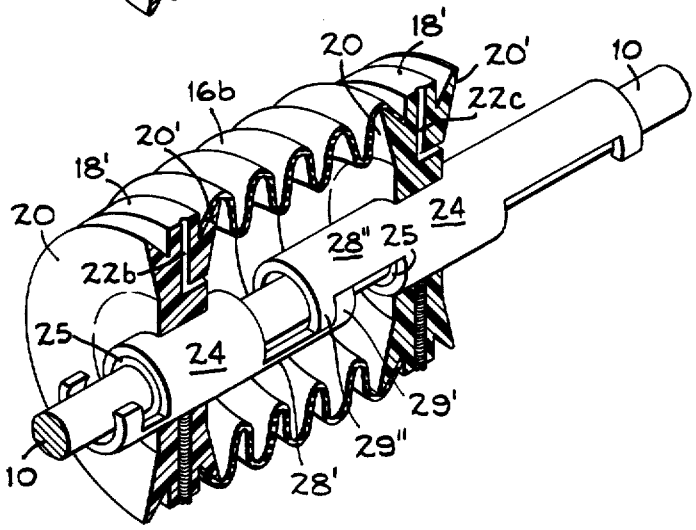
Fig_5

ACTUATING MECHANISM

BACKGROUND OF THE INVENTION

The present invention relates to actuating mechanism intended to move an indicator, an operational tool, or a structural component over precisely predeterminable distances to sought points of operation. Actuating mechanisms of this type are frequently known as locators, they have great utility, and are widely in use, in the wiring of high density circuit panels for television sets and computors where they may be employed to find corresponding contact points or move operational tools such as wire wrappers or soldering equipment to the proper points of operation according to a master plan. In the construction industry they may be employed to move structural components into the proper positions for erection or connection.

OBJECTS OF THE INVENTION

It is an object of my invention to provide an actuating mechanism of the type referred to, that may be operated to move indicators, operational tools or constructional components with the highest degree of precision over precisely predeterminable distances to the proper points of operation.

Another object of the invention is to provide an actuating mechanism of the type described that may be constructed to service very small or very large distances, as desired.

Still another object of the invention is to provide a precision actuating mechanism of the type described, that may be operated to move an indicator, an operational tool or a structural component selectively over a wide variety of distances which may differ from each other by minute or large increments as the case may be.

Automatic operation of the precision actuators or locators of the type her under consideration, requires usually the use of complex electronic logic circuits, electronic memories, encoders and electric motors.

It is an additional object of the present invention to provide a precision actuating mechanism that may be automatically operated directly from a perforated tape without need for the interposition of logic circuitry, encoders, electronic memories and like complex systems.

Furthermore it is an object of my invention to provide a precision locating mechanism of the type referred to, that is capable of moving indicators, operational tools, and structural components over precisely predeterminable distances to desired points of operation without the use of electric motors.

BRIEF DESCRIPTION OF THE DRAWINGS

These and other objects of the present invention will be apparent from the following description of the accompanying drawings which illustrate a preferred embodiment thereof and wherein

FIG. 3 is an exploded fragmentary perspective of the contraction and expansion limiting mechanism within the individual components of the actuator mechanism shown in FIGS. 1 and 2;

FIG. 4 is a fragmentary perspective of the contraction and expansion limiting mechanism in condition in which it limits contraction of a component of the actuator mechanism;

FIG. 5 is a fragmentary perspective, similar to FIG. 4, of the same limiter mechanism in condition in which it limits expansion of the component;

SUMMARY OF THE INVENTION

In accordance with my invention I mount upon a common shaft a sequence of interconnected actuating components of selectively variable length axially of the shaft for movement relatively to said shaft with one of the ends of said sequence held positively against such movement and the other end free to move along said shaft in response to variations in the length of anyone or all of said components. Each of said components is provided with limit stop means for positively limiting its length in its condition of maximum contraction and also in its condition of maximum expansion, so that its increment of elongation is positively predetermined, and I provide means selectively operable to set said actuating components individually to either their condition of minimum length or their condition of maximum length. The arrangement is preferably such that the change in length obtainable in the individual components differs from component to component. Thus, an indicator or holding means secured for instance to the free movable end of the sequence of components may selectively be set with highest degree of precision to a wide range of different positions by activating selected ones of said components to assume either their position of minimum length or their position of maximum length.

DETAILED DESCRIPTION OF A PREFERRED EMBODIMENT OF THE INVENTION

Figure 1:
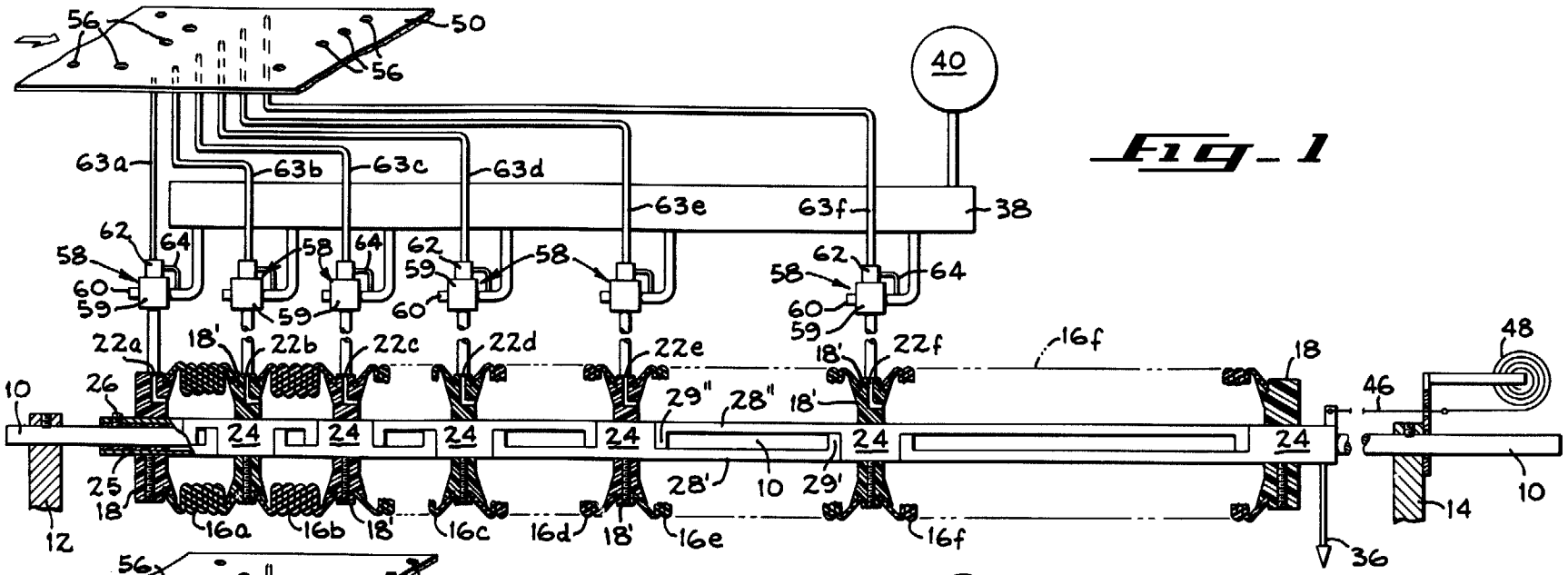
FIG. 1 is a schematic longitudinal section through the actuator mechanism of my invention in contracted condition.
Figure 2:
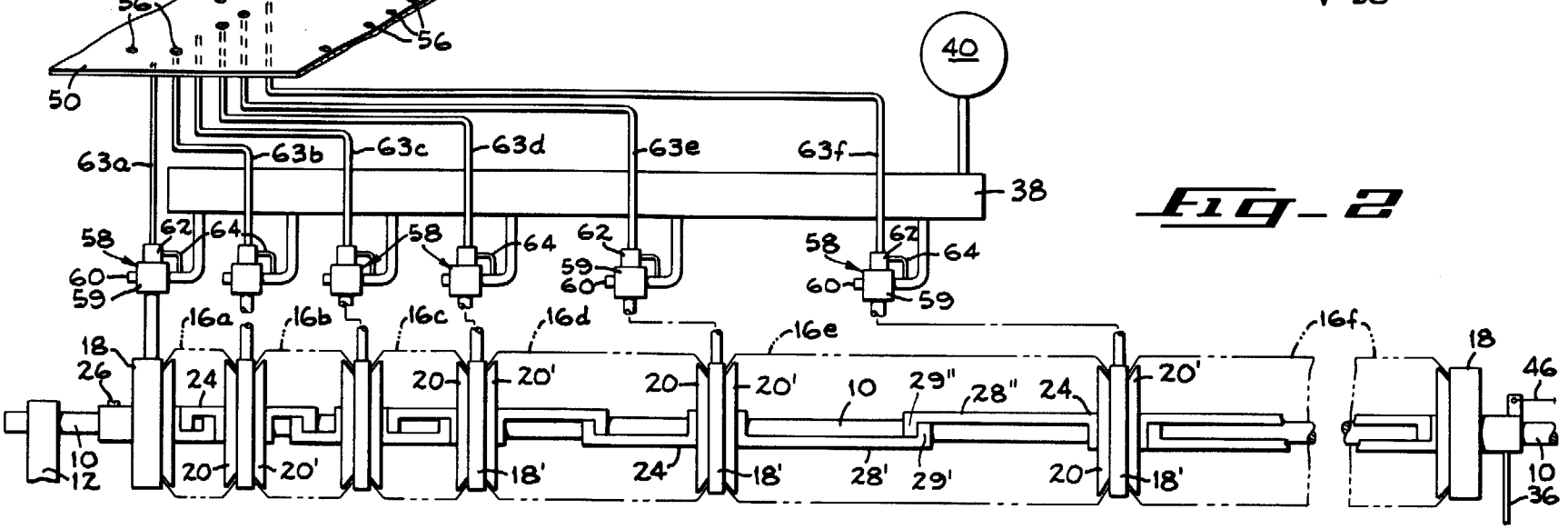
FIG. 2 is a schematic fragmentary section similar to FIG. 1 showing the actuator mechanism of the invention in partially expanded condition.

The device of the invention shown in FIGS. 1 and 2 comprises a horizontally disposed shaft 10 that is held firmly in suitable uprights 12 and 14 near its opposite ends. Supported upon said shaft are six expansible components 16*a*, 16*b*, 16*c*, 16*d*, 16*e* and 16*f* all of which are shown in fully contracted position in FIG. 1. In the particular embodiment of the invention shown in the drawing these components are formed by expansible tubular bellows of equal diametrical width whose opposite ends are closed in an air tight manner by circular disks 18 or 18' respectively which have circumferential grooves in their cylindrical outer surface that define flanges 20 over which the ends of the bellows are engaged (FIGS. 4 and 5). Each two consecutive bellows share a common disk 18' which separates their interiors and interconnects them mechanically for movement in unison on and relative to shaft 10. Accordingly the disk 18' have two circumferential grooves in their cylindrical outer surface which form flanges 20 and 20' on opposite sides of each disk over which the adjacent ends of two consecutive bellows are engaged in an air tight manner.

Individual air channels 22*a*, 22*b*, 22*c*, 22*d*, 22*e* and 22*f* respectively, lead from the cylindrical outer surfaces of the left most disk 18 and the intermediately located disks 18' into the interior of the bellows 16*a* to 16*f*, respectively. In the particular embodiment of the invention illustrated in the accompanying drawing the bellows 16 differ in axial length, the left most bellows 16*a* being the shortest with every consecutive bellows in the direction toward the right being somewhat longer so that the right most bellows 16*f* is the longest; and each consecutive bellows to the right is capable of expansion by an increment that is larger than the increment of expansion of which the directly preceeding bellows is capable.

The disks 18' and the right most disk 18 are mounted upon shaft 10 in such a manner that the bellows may shift relative to said shaft, but means are provided that block movement of the total train of bellows relative to the shaft in the left direction while leaving its right end free to shift relative to said shaft in response to changes in the axial length of one or all of the bellows. For this purpose each of the disks 18, 18' is mounted upon a tubular hub 24 that is engaged over the shaft 10 and which maybe provided with an internal bushing 25 of a smooth plastic such as the plastic known under the trade name DELRIN (FIG. 1). The hub 24 of the left most disk 18 is rigidly secured to the shaft 10 by a set screw 26 and is thus inmovable relative to shaft 10 while all the other hubs including the right most hub 24, i.e. the terminal hub on the right end of the sequence of bellows upon shaft 10 may move freely relative to said shaft. Thus, whatever changes in their length the individual bellows may undergo, the sum total of these changes becomes effective on the right end of the train of bellows upon the shaft, i.e. the right most hub 18.

Means are associated with each bellows that limit very precisely the minimum length to which the bellows may contract and which limit with equal precision the maximum length to which the bellows may expand. For this purpose the hubs 24 of disks 18 or 18' as the case may be, on the opposite ends of each bellows are provided with buffer members that project from diametrically opposite sectors of the opposed end surfaces of the two hubs envolved and which strike against oppositely located sectors of the opposed end surfaces of the two hubs when the bellows contracts. In this manner they block positively any further reduction of the distance between the hubs and hence limit effectively the minimum axial length of the particular bellows; in addition said buffer members have annular extensions which act in the manner of a catch whenever the hubs move away from each other, and thus prevent positively any further elongation of the bellows. Having reference to FIGS. 3, 4 and 5, the inner annular end surfaces of the hubs 24 upon which are mounted the disks 18' that close and constitute the opposite ends of bellows 16*b*, are provided with extensions 28' and 28'' that project from oppositely located sectors of the opposed annular end surfaces of the tubular hubs 24 and are in fact tube segments that are engaged over and slide on shaft 10. The ends of said shafts carry annular members 29' and 29'', respectively, of more than semicircular angular width whose outer end surfaces are precision ground. Upon contraction of bellows 16*b* these surfaces come into contact with corresponding sectors of the opposed end surfaces of the hubs that carry the closure disks 18' of bellows 16*b*. These surfaces are likewise precision ground. Thus, when these surfaces strike each other, further approach of the opposed hubs and the closure disks 18' of the bellows 16*b* is positively blocked at a precisely predeterminable distance between said disks. Hence the axial length of the bellows 16 *b* has reached its state of maximum contraction. This state of maximum contraction may be determined very precisely by the length, axially of shaft 10, of the arms or extensions 28', 28''. It will be understood that for proper operation and maximum effectiveness, the length of extensions 28', 28'' must be identical.

As pointed out hereinbefore, the annular buffer members 29', 29'' at the ends of arms or extensions 28' and 28'' respectively are of more than semicircular angular width. Hence when the bellows 16*b* expands and the hubs of the closure disks of said bellows move away from each other, the annular members 29', 29'' slide along shaft 10 toward each other until the inner surfaces of their tips strike against each other and block further elongation of the bellows 16*b* positively in the manner of a catch at a precisely predeterminable maximum axial length thereof which depends again on the length of the arms or extensions 28', 28'' on the hubs of the closure disks 18'.

In the exemplary embodiment of the invention illustrated in the drawing (FIGS. 1 and 2) six bellows 16*a* to 16*f* are slidably supported on the shaft 10 and each consecutive bellows in the direction from left to right is larger in length and is capable of greater elongation than the preceeding one as pointed out hereinbefore, and each is provided with contraction and expansion limiting means of the type described above in which the length of the buffer arms 28 axially of shaft 10 will differ from bellows to bellows. As also pointed out hereinbefore, means are provided in the form of set screw 26 to block positively any movement of the train of bellows 16 to the left on shaft 10 which might otherwise occur as the result of expansion of any one or all of the bellows 16. Thus, any change in the axial length of the train of bellows on shaft 10 evidences itself solely in changes of the position of the right most hub 24 axially of shaft 10. Accordingly indicator means are secured to the right most hub as represented by the arrow 36 to indicate a point that is to be found by operation of the actuating mechanism of the invention. Alternatively, a tool may be rigidly supported from the free terminal hub 24 to be carried to the proper point of operation by actuation of the mechanism of the invention, or the right most free terminal hub 24 may be provided with holding means for gripping and carrying structural components to their proper place of application where they are to be set up or fitted into a previously erected structure.

Figure 6:
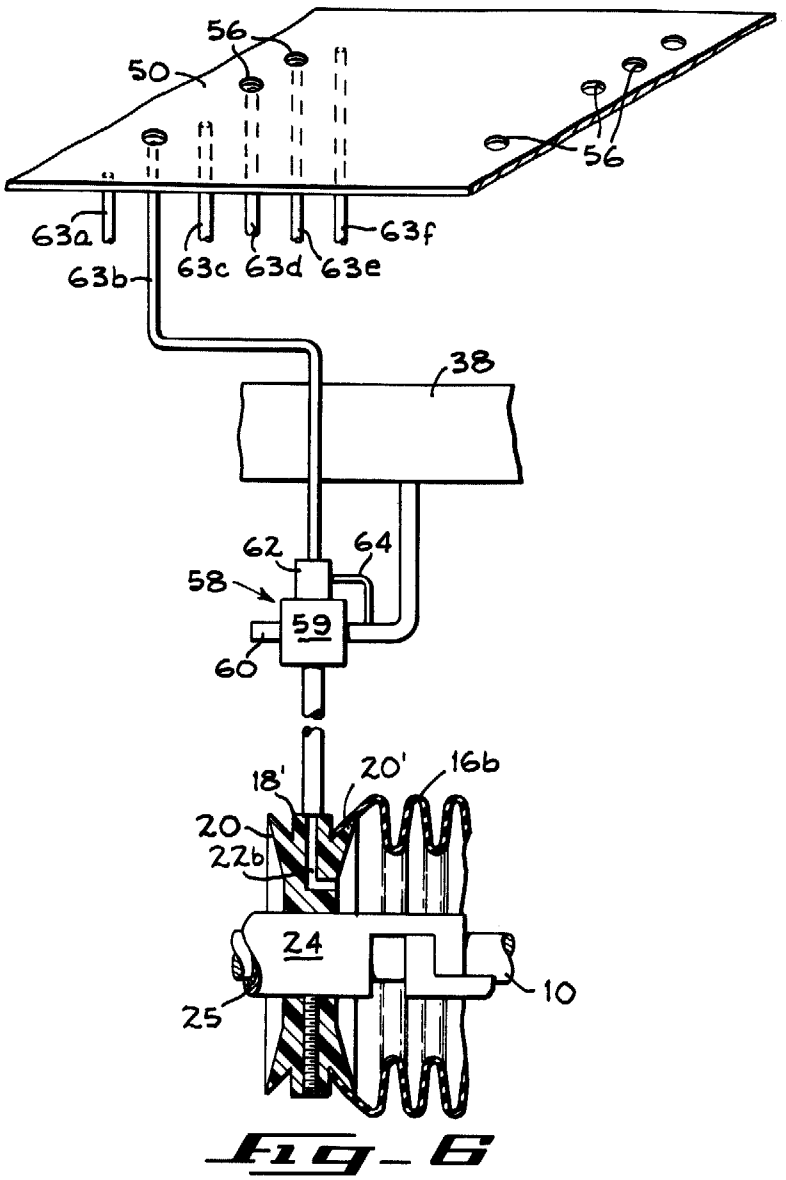
FIG. 6 is a detail view of the pneumatic control circuitry for the actuator mechanism shown in FIGS. 1 and 2.

When all the bellows 16 on shaft 10 are in fully contracted position, the actuator of the invention assumes its condition of shortest length. This is achieved by evacuating the interior of all the bellows causing them to contract. For this purpose every one of the bellows is connected through the channels 22 in one of its closure disks 18 and or 18' as the case may be, to a manifold 38 which is kept in a constant state of evacuation by a continuously operating vacuum pump schematically indicated by the circle 40 (FIGS. 1 and 2). Valve means indicated by block 42 in FIG. 7 and blocks 58 in FIGS. 1, 2 and 6 are provided in the lines between the interior of the bellows 16 and the evacuation manifold 38 to control individually the state of evacuation in the interior of every one of the bellows. These valves may be mannually controlled or may be controlled automatically by electric circuitry or directly by program tapes as will be explained hereinafter.

To effect expansion of the bellows the free terminal hub 24 at the right end of the train of bellows on shaft 10 is connected by a cord 46 to a constant tension spring indicated at 48 in FIG. 1, which is not sufficiently strong to expand any one of the bellows while they are in an evacuated state, but is strong enough to fully expand any one or all of them as soon as the vacuum in any one or all of them is abolished and atmospheric pressure is allowed to prevail in their interiors. Thus by manipulating the control valves 42 or 58 to cut communication with the evacuation manifold 38 and connect the channels 22 to the outside atmosphere, any one or all of the bellows may be caused to expand to their full length or lengths as determined by the hereinbefore described expansion limit means under the force of spring 48, and since the bellows are positively interconnected through the disks 18' the position of indicator 36 will change to an extent depending on the number and size of the bellows expanded.

Figure 7:
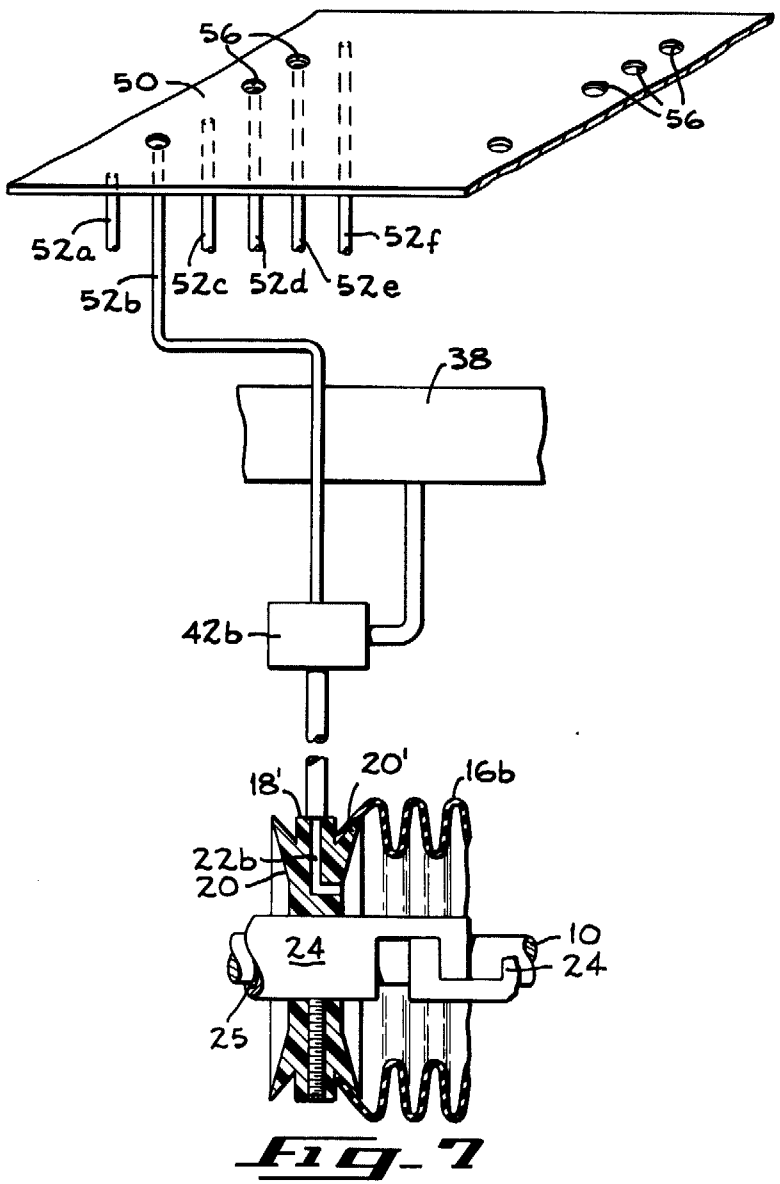
FIG. 7 is a detail view, similar to FIG. 6 of a modified form of pneumatic control circuitry for the actuator mechanism shown in FIG. 1 and 2

While the state of evacuation in the individual bellows and hence the effective length of the actuating mechanism may be mannually controlled by manipulation of valves 42 as indicated above, the described actuating mechanism lends itself to direct automatic control by perforated program tapes. In the particular embodiment of the invention illustrated in FIG. 7 a tape 50 passes over the open ends of six air lines 52*a* to 52*f* which lead to six control valves of which only valve 42*b* is shown in FIG. 7. The transverse width of tape 50 is sufficiently large to cover and close every one of the open ends of lines 52, and as long as this is the case the valves 42 are set to connect every one of the bellows to the evacuation manifold 38 while blocking communication with the outside atmosphere. The tape 50 carries the directions for selected operation of the actuating mechanism of the invention in the form of transversely arranged, consecutive rows of holes 56 and conventional drive means (not shown) are provided to advance the tape selectively over the open ends of channels 52*a* to 52*f*. As soon as actuation of the tape drive mechanism moves a hole 56 of tape 50 into registry with the end of a channel 52, air may enter the interior of the particular bellows to which the channel leads and pressure responsive means in valve 42 may be arranged to cut communication between the particular bellows and the evacuation manifold 38. Alternatively, the size of the air admittance channel may be made large enough so that the volume of air entering the bellows overwhelms the effect of the evacuation manifold. As a result the force of spring 48 operates to expand the particular bellows precisely to the extent permitted by its expansion limiting means. When renewed advance of the tape covers the end of the channel leading to an expanded bellows the described occurances are reversed, the interior of the bellows is cut off from communication with the outside atmosphere and the pressure responsive means in valve 42 reconnects the interior of the bellows to the evacuation manifold 38. In any case, with closure of the particular air admittance channel the evacuation manifold evacuates the bellows and as a result the spring 48 is unable to keep the bellows expanded and it contracts to the extent permitted by its contraction limit stop means. Thus, the actuating mechanism of the invention returns to its initial length.

In practise the use of more sophisticated valve arrangements of the so-called pilot-operated type speed up the rate of operation in setting the bellows selectively to contracted or expanded condition with a rapidity far greater than is possible when the holes in the tape control the flow of air into the interior of the bellows directly. The schematic representation of the pneumatic control system for the actuating mechanism of the invention made in FIGS. 1, 2 and 6 represents the use of such a pilot valve arrangement all of conventional design wherein the bellows control means is a composite valve 58 having a portion 59 that controls the outflow of air to the evacuation manifold 38 and the inflow of air from the outside through an inlet 60. This valve portion 59 in turn is controlled by an airpressure responsive pilot valve portion 62 that responds to the pressure conditions in the channels 63*a* to 63*f* which constitute the tape controlled pilot lines of the arrangement. Whenever the open end of a pilot line 63 is covered by the tape 50, a bleeder line 64 from pilot valve 62 to the evacuation line reduces the air pressure in line 63 and in response thereto the pilot valve 62 sets valve 58 to a condition wherein it connects the interior of the bellows to the evacuation manifold and blocks influx of air through inlet 60. However, when a perforation 56 in tape 50 moves into registry with the end of a channel 63 the pilot valve 62 responds to the atmospheric pressure supplied through pilot channel 63 and sets the valve 62 to a condition wherein it cuts communication with the evacuation manifold 38 and open inlet 60. The bellows, therefore, expands under the force of spring 48.

In the accompanying drawing the locator mechanism of the invention is shown as composed of six interconnected consecutive bellows stacked upon a common shaft. It will be understood that the actuator mechanism of the invention may comprise any number of bellows and the individual bellows may be large or small, and yet the mechanism will function in basically the same manner, only its actual size and the number of increments of expansion and contraction which it provides, will be different. In the exemplary embodiment of the invention shown in the drawing each consecutive bellows in the direction from left to right is of such length and construction that upon expansion it provides twice the elongational increment provided by expansion of the directly preceeding bellows. An actuator mechanism in accordance with my invention when so constructed provides a very high number of incremental positions of the indicator or tool holder 36, to which it may be set by selective activation of its individual components namely: $2^n$ where "$n$" is the number of components comprised in the actuating mechanism and the sum total includes the initial fully contracted state of the mechanism as a position. The actuator mechanism of the invention may be constrcted to service very large or very small ranges of distances depending on the size of the individual bellows; in other words the device of the invention is of great flexibility as to is application. It can be constructed to service very large or very small distances, provide few or many incremental positions, carry heavy loads or precision tools, and it is inherently a precision instrument due to the nature of the mechanism which limits contraction and expansion of the individual bellows positively to precisely predetermined distances, and also due to the manner in which the individual bellows are stacked on, and interconnected for sliding movement in unison upon a common shaft whenever the status of any one of the bellows is changed.

The described actuating mechanism is easy to operate. As explained hereinbefore, it may be automatically controlled according to predetermined programs directly from perforated program tapes without the use of logic circuitry, electronic memories and encoders. It provides its own moving power, and does not require electric motors for shifting the indicator or whatever tool or structural component may be connected to the mechanism at this point. However, it is within the purview of this invention to control operation of the disclosed actuator mechanism, i.e. the air control valves 42 or 58, in the conventional manner through encoders and logic circuitry, if desired and if circumstances would warrant such complex arrangements in preference to the far simpler direct control arrangement explained above.

In the exemplary embodiment of the invention described in detail hereinbefore and illustrated in the accompanying drawing, the length of the bellows is controlled by vacuum lines, i.e. the bellows contract and assume a condition of minimum axial length when their interior is evacuated, and they expand and assume their maximum axial length under the force of a spring when atmospheric pressure is admitted to their interior. It will be understood by those skilled in the art that the same changes in the length of the bellows may be effected by the use of pressure lines, i.e. the bellows may be constructed to assume initially their fully contracted position automatically under atmospheric conditions, and may be expanded to the full axial length permitted by the limit stop means of the invention by supplying air under predetermined pressure into their interior.

Also, while the emobidment of the invention specifically described hereinbefore employs expansible bellows as the components of variable axial length of which the actuating mechanism of the invention is comprised, pneumatic cylinders whether controlled by vacuum lines or pressure lines may take the place of the bellows in the actuating mechanism of my invention. Similarly, other fluid controlled components of predeterminably variable length, such as hydraulic cylinders may be employed in constructing a precision actuating mechanism in accordance with the present invention. In fact, it is feasable within the purview of the present invention to employ components of predeterminably variable length whose changes in length are obtained by electromagnetic means.

While I have expained my invention with the aid of a preferred embodiment thereof, it will be understood that the invention is not limited to the specific constructional details shown and described by way of example which may be departed from without departing from the scope and spirit of my invention.

Whereover the term "indicating means" is used in the following claims, this term is understood to include not only an actual indicator for pointing out a desired point of operation, but also holding means for tools that are to operate at said point or for structural components that are to be carried to the sought point to be joined there to an existing structure.

I claim:

1. A precision actuating mechanism comprising a stationary shaft, slidably mounted upon said shaft a sequence of interconnected actuating components of predeterminably variable length axially of said shaft having limit stop means for limiting positively their condition of maximum axial length and their condition of minimum axial length, means selectively operable to adjust the axial length of said components individually to either their maximum axial length or their minimum axial length, means holding one end of said sequence of components against movement relative to said shaft, and means supported at the free opposite end of said sequence of components for indicating any changes of the sum total of the axial lengths of said components.

2. A precision actuating mechanism comprising a stationary shaft, a sequence of mechanically interconnected bellows slidably mounted upon said shaft in end to end relation having limit stop means for positively limiting the axial length of said bellows in their condition of maximum contraction and their condition of maximum expansion, means selectively operable to (adjust) set the axial length of said bellows individually to either their condition of maximum contraction or their condition of maximum expansion, means holding one end of said sequence of bellows positively against movement relative to said shaft, and means supported from the free opposite end of said sequence of bellows for indicating any changes in the sum total of the axial lengths of said bellows.

3. An actuating mechanism according to claim 2 wherein said means selectively operable to set said bellows individually to either their conditions of maximum contraction or maximum expansion are pneumatic evacuation lines in combination with spring means operative at the free end of said sequence of bellows to urge said bellows into their fully expanded conditions.

* * * * *